United States Patent [19]

Zmijewski

[11] 4,448,184

[45] May 15, 1984

[54] SINE BAR GRINDING WHEEL DRESSER

[76] Inventor: Raymond W. Zmijewski, R.D. #7 Station Rd., Erie, Pa. 16510

[21] Appl. No.: 346,256

[22] Filed: Feb. 5, 1982

[51] Int. Cl.[3] ..... B24B 53/12

[52] U.S. Cl. ..... 125/11 B; 51/216 A; 51/DIG. 31

[58] Field of Search ..... 125/11 NT, 11 B, 11 R; 51/216 A, 217 A, DIG. 31, 216 R

[56] References Cited

U.S. PATENT DOCUMENTS

| | | | |
|---|---|---|---|
| 2,378,743 | 6/1945 | Wisne | 125/11 B |
| 2,425,453 | 8/1947 | Bavosi | 125/11 B |
| 2,449,459 | 9/1948 | Eckert | 51/217 A |
| 2,733,702 | 2/1956 | Barrett | 125/11 B |
| 2,995,962 | 8/1961 | Dietz | 51/216 R |
| 3,046,968 | 7/1962 | White | 125/111 VT |
| 4,262,649 | 4/1981 | Espinosa | 125/11 B |

*Primary Examiner*—Harold D. Whitehead
*Attorney, Agent, or Firm*—Charles L. Lovercheck; Wayne L. Lovercheck; Dale R. Lovercheck

[57] ABSTRACT

A wheel dresser having a diamond point carried by a slider supported on an arm swung from the top of a column support and adapted to have its lower end swing into engagement and rest against a gage block supported against the column. The arm has a cylinder attached to its lower end that engages the gage block to provide a positive precision locating device for the arm so that a sine bar is formed by the arm supported on the column.

1 Claim, 2 Drawing Figures

SINE BAR GRINDING WHEEL DRESSER

REFERENCE TO PRIOR ART

Various tool dressing devices have been proposed. For example, the devices shown in U.S. Pat. Nos. 1,862,379; 2,415,121; 3,688,444 and 3,623,852. None of these patents use a sine bar swingably supported on a column such as applicant has provided which slidably support a wheel dressing device having a diamond point.

OBJECTS OF THE INVENTION

It is an object of the invention to provide an improved wheel dresser.

Another object of the invention is to provide a wheel dresser wherein a diamond point is slidably supported on a sine bar.

Another object of the invention is to provide a wheel dresser that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
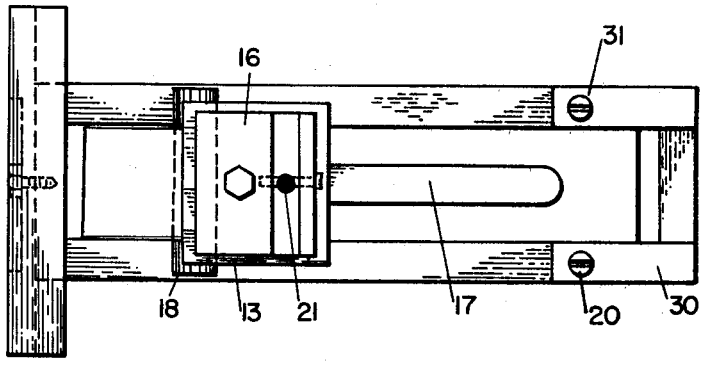
FIG. 1 is a front view of a wheel dresser according to the invention.
Figure 2:
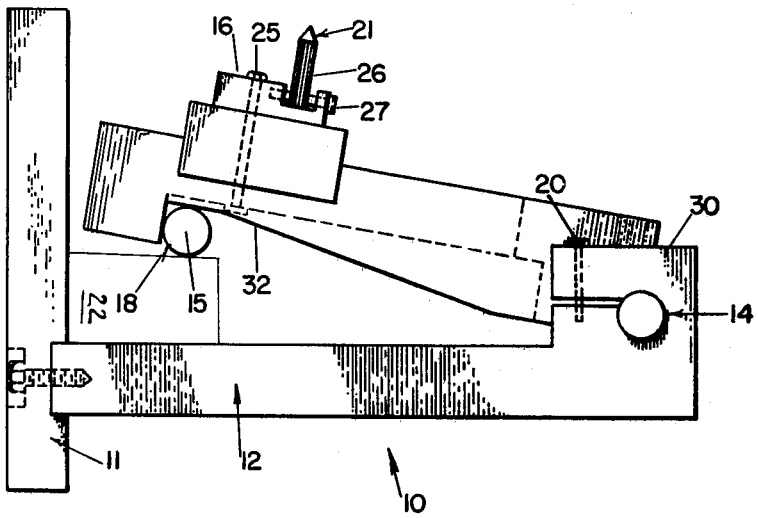
FIG. 2 is a side perspective of the wheel dresser shown in FIG. 1.

Now, with particular reference to the drawings, I show a grinding wheel dresser indicated generally at 10 comprising a base 11 and a column 12 fixed to the base and extending upwardly therefrom. The column 12 has two spaced forwardly extending bosses 30 and 31 fixed to its upper edge and extending forwardly therefrom and providing a space between it. The space receives the upper end of the arm 23. The arm 23 is swingably supported on the bosses 30 and 31 by the axle 14 which extends through bores in the spaced bosses and is held in place in the bosses against rotation by the set screws 20.

A cylinder 15 is fixed in a groove 32 at the lower end of the arm and the cylinder 18 has a cylindrical outside periphery that can rest against a gauge block 22 supported on the top of the base 11 in front of the column 12.

A slot 17 is formed in the front of the arm 23 and the slot receives the slider 16.

The diamond point 21 has a cylindrical base 26 that is held in a notch in front of the slider 16 by the set screw 27. The slider 16 is slidably held in the T-shaped slot 17 in the arm 13 by a bolt 25 that extends through the slider and rests on the rear edge in the notch at the back of the arm. It will be noted that axle 14 and cylinder 18 must have exactly the same diameter.

To use the device the base 11 will be supported on a suitable surface adjacent a grinding wheel and the point 21 will be brought up into close engagement with the grinding wheel A. The grinding wheel slider 16 will then be slid up and down on the arm and a suitable gage block 22 will be supported on the base between the pedestal 12 and the cylinder 15.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A grinding wheel dresser comprising a base and a column supported on the base and extending upwardly therefrom and fixed thereto, said column having two forwardly extending bosses fixed to its upper end, an arm having a first end and a second end, said base being fixed to said second end of said column and disposed generally perpendicular to said column and underlying said arm, said base having a lower surface adapted to rest on a magnetic table, said first end of said arm being received between said bosses, an axle extending through said bosses and through said first end of said arm, a cylinder fixed to said arm adjacent said second end on the side thereof adjacent said column, said arm terminating adjacent said base and providing a space between said cylinder and said column to receive a gauge block resting on said base and against said column with said cylinder disposed against the block, a T-shaped slot in the arm, said T-shaped slot extending from said first end to a position adjacent said second end, a slider having a follower received in said T-shaped slot and sliding on the outer surface of said arm remote from said column, a diamond point on said slider adapted to engage a wheel to be dressed whereby said slider can be slid up and down on said arm to move said diamond point in a path disposed at an angle to the vertical determined by the thickness of said gauge block.

* * * * *